US005333663A

United States Patent [19]

Eger

[11] Patent Number: 5,333,663

[45] Date of Patent: Aug. 2, 1994

[54] CASSETTE-TYPE AWNING

[75] Inventor: Heinz Eger, Bissingen-Ochsenwang, Fed. Rep. of Germany

[73] Assignee: MHZ Sonnenschutztechnik GmbH, Kirchheim/Teck, Fed. Rep. of Germany

[21] Appl. No.: 78,141

[22] Filed: Jun. 16, 1993

[30] Foreign Application Priority Data

Jun. 17, 1992 [DE] Fed. Rep. of Germany ..... 4219832

[51] Int. Cl.[5] ..... E04F 10/00

[52] U.S. Cl. ..... 160/22; 160/66; 135/89

[58] Field of Search ..... 160/22, 66, 23.1, 24, 160/68, 69, 70, 79; 135/89

[56] References Cited

FOREIGN PATENT DOCUMENTS 422720 4/1991 European Pat. Off. ..... 160/22
0439702A1 8/1991 European Pat. Off. .
2821103 11/1979 Fed. Rep. of Germany .
3015990 11/1981 Fed. Rep. of Germany ..... 160/22
8811102 12/1988 Fed. Rep. of Germany .
839890 4/1939 France .
851266 1/1940 France .
2664634 1/1992 France .

*Primary Examiner*—Blair M. Johnson
*Attorney, Agent, or Firm*—Frishauf, Holtz, Goodman & Woodward

[57] ABSTRACT

A cassette-type awning comprises an awning housing (2) containing, a winding shaft (8) rotatably mounted therein and, at the wall side the joints of articulated arms (85, 86). The cassette housing (2) is substantially open on its side remote from the wall and is closed by a three-part drop rail (11) when the awning is retracted. The center part (51) of the drop rail (11) is hinged to the articulated arms (85, 86) and also serves as carrier for a top and a bottom flap (53, 55) which are pivoted in the direction towards the awning cloth (9) when the awning is extended and completely close the housing (2) when the awning is retracted in order that the articulated arms (85, 86) and the wound-up roll of awning cloth (9) will be protected from weather.

22 Claims, 3 Drawing Sheets

CASSETTE-TYPE AWNING

FIELD OF THE INVENTION

The invention relates to a cassette-type awning.

BACKGROUND

An awning with articulated arms is known from EP-A-0 439 702. The articulated arms and the roll of cloth are accommodated for protection against the weather in an awning case when the awning is retracted. In the known awning, the awning case is provided with a relatively high opening over its entire length and the top and bottom rims of the opening each have two flaps hinged to them to close the interior of the case off from the outside when the awning is retracted. To extend the awning, the two flaps are pivoted apart in order that the drop rail drawn back into the interior of the awning case will be able to move out with the awning cloth attached to it. Since, in the closed state, the drop rail is drawn back behind the flaps, the structural depth is relatively large in comparison with simple sleeve-type awnings in which the drop rail rests on the outside on the mouth of the cassette.

THE INVENTION

It is an object of the invention is to create a cassette-type awning which in the retracted state has a closed, aesthetically pleasing shape without the drop rail assuming a bulky shape.

Briefly, the drop rail is a multi part structure. Owing to the multipart design of the drop rail in the longitudinal direction, corresponding parts of the drop rail which have to be widened out to close the cassette opening can be brought up closer to the awning cloth in the extended state, which results in a short extent of the drop rail in the vertical direction. On the other hand, perfect sealing of the cassette opening is achieved, and a closed contour is obtained in the retracted state.

With the new solution, the drop rail lies approximately at the same point as in simple sleeve-type awnings in which the drop rail only rests on the outside on the mouth of the cassette and so the new solution, measured in the direction perpendicular to the wall to which the awning is attached, does not have a larger depth.

Furthermore, the cassette-type awning has the advantage that the articulated arms are protected and in the retracted state are not unnecessarily subjected to weathering.

In accordance with a feature of the invention, the drop rail has a main part and another part, in form of a movable flap, for example and preferably arranged below the main part of the drop rail. This results in a space saving structure.

Grazing of the awning cloth when the awning is being extended is prevented, in accordance with another feature of the invention, by the drop rail also being provided with a second flap at the top because this then produces a cassette opening which has a rim which cannot come into contact with the awning cloth in any operating position. This results in a particularly long life without the danger of ugly drag marks occurring on the awning cloth.

The new drop rail makes a cassette opening possible in which the bottom and/or the top rim lie in a vertical plane containing the winding shaft. This also facilitates the accessibility during installation and maintenance work.

A particularly compact outer design is achieved by the cassette housing having a cross-section with the outer contour of an oval when the awning is in the retracted state.

The kinematics for actuating the bottom flap are very simple if it is pretensioned by a spring device with the effect of an upwardly directed movement and guiding elements are provided on the cassette housing to move the flap downwards to rest on the bottom rim of the cassette opening when the awning is retracted.

Assembly is simplified by the cassette housing also being divided in the longitudinal direction because the individual parts can then be easily adapted to the respective purpose with respect to the material used. It is, for example, advantageous for the top part to be extruded material, whereas the bottom part constitutes a simple sheet-metal part as the bottom part serves a covering purpose only, whereas the strength is substantially produced by the top part. Further developments of the invention are the subject matter of subclaims.

DRAWINGS

An embodiment of the subject matter of the invention is illustrated in the drawings which show:

FIG. 1 a perspective overall view of an awning according to the invention;

FIG. 2 a cross-sectional view of the awning according to FIG. 1 in the closed state; and FIG. 3 a cross-sectional view of the drop rail of the awning according to FIG. 1 in the extended state.

DETAILED DESCRIPTION

Figure 1:
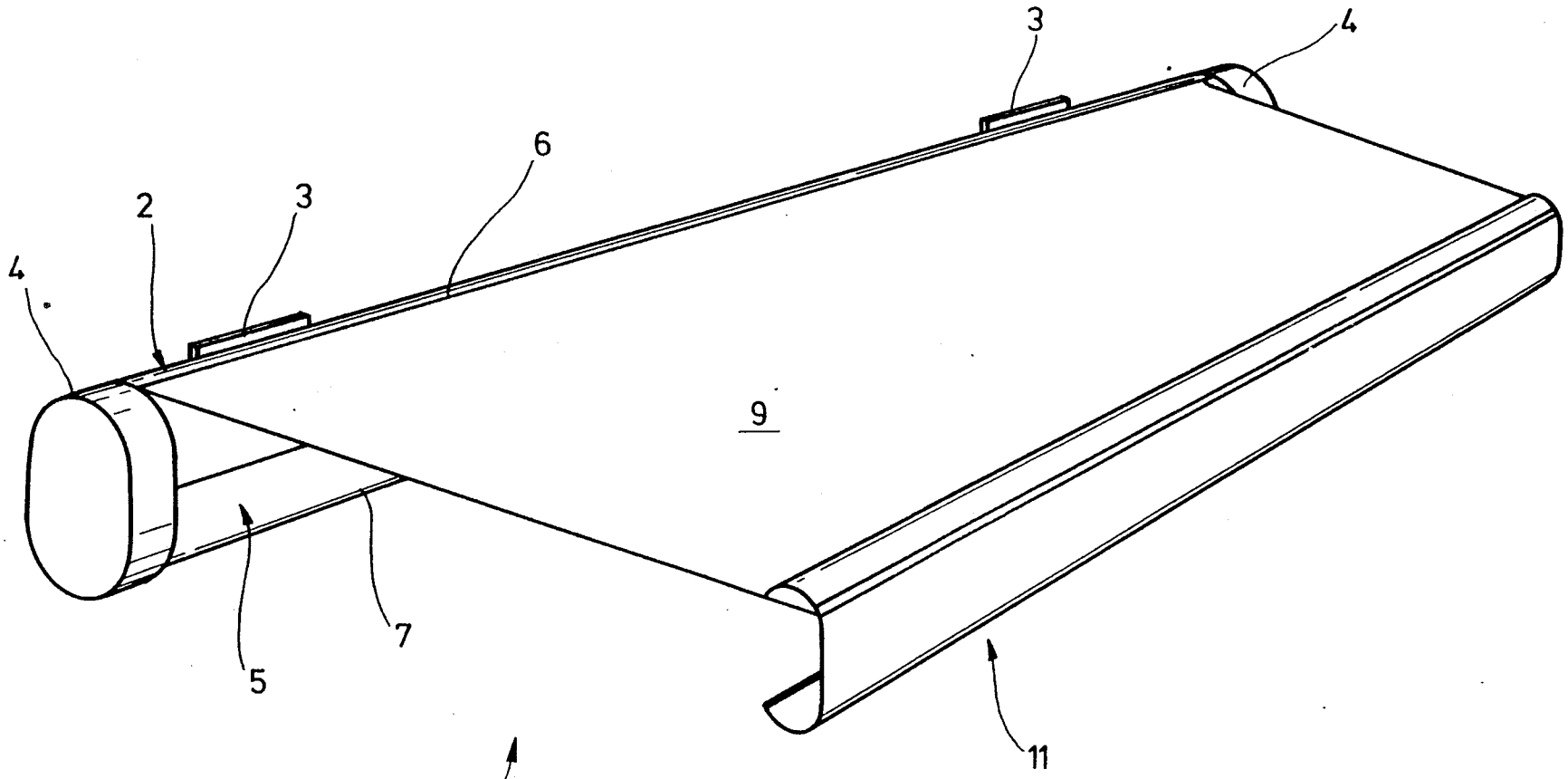

FIG. 1 shows a cassette-type awning 1 with an elongate cassette housing 2 of approximately oval cross-section which is attached by means of two wall holders 3 to the wall of a building which is not illustrated. The cassette housing 2 is closed off at the ends by two cup-like caps 4 of adapted cross-section and a cassette opening 5 extends continuously over the entire length of the cassette housing between these and is delimited by a top rim 6 and a bottom rim 7.

Figure 2:
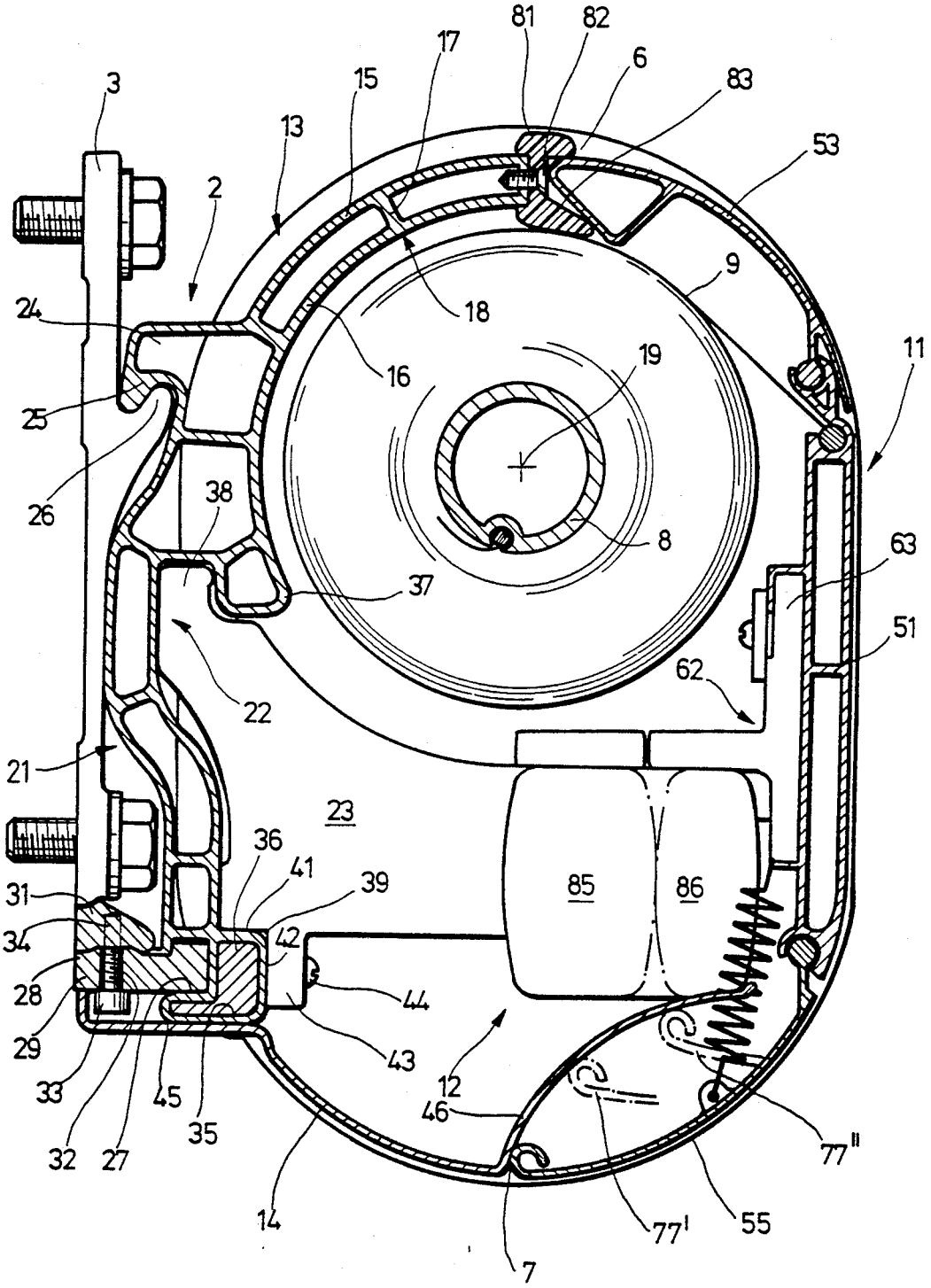

The cassette housing 2 contains a winding shaft 8, apparent from FIG. 2, which is rotatably mounted in bearings in the end caps 4 and to which an awning cloth 9 is attached with an edge thereof. The other edge of the awning cloth 9 extending parallel to the latter is attached to a drop rail 11 which is connected to the cassette housing 2 by articulated arms 12 which are covered by the awning cloth 9 and are only partly recognizable in the other two Figures.

When the awning 1 is in the retracted state, the articulated arms 12 disappear in the cassette housing 2 and the cassette opening 5 of the latter is completely closed by the drop rail 11.

The design of the cassette housing 2 and the drop rail 11 is described in detail with reference to FIGS. 2 and 3.

The cassette housing 2 consists of a double-walled extruded part 13 which forms part of the top and the rear wall of the cassette housing 2 and of a sheet-metal shaped part 14 which constitutes the bottom. In the extruded shaped part, both walls 15 and 16 which, with the exception of a few hook-shaped bulges, extend essentially parallel to one another are joined in a known way by a number of crossbars 17, which produces cavities extending throughout the longitudinal direction of the cassette housing 2 which are open in the direction towards the end caps 4.

The top part 13 consists, with reference to the cross-section, of a quarter-circle-shaped curved piece which starts at the top rim 6 and lies through approximately 90° around the winding shaft 8, with the center of curvature coinciding with the axis 19 of the winding shaft 8. Adjoining the curved piece 18, the extruded shaped part 13 forms a rear wall 21 which is provided in the direction towards the wall holder 3 with a bulge 22 to make room for a part 23 of a hinge of the articulated arm 12 at the wall side.

To hold the cassette housing 2 on the two wall holders 3, the curved section is provided on its outer wall 16 at the transition to the rear wall 21 with a hook-shaped protrusion 24 which likewise extends over the entire length of the extruded shaped part 13. It forms a downwardly pointing hook-shaped bar 25 which cooperates with a corresponding, upwardly pointing hook 26 of the otherwise plate-shaped wall holder 3. Owing to the cooperation of the hook 26 with the hook-shaped bar 25, the vertical force, i.e., the weight of the cassette-type awning 1 is diverted into the two wall holders 3.

To prevent the extended awning 1 from being lifted up by a gust of wind from underneath the awning cloth 9, the bottom end of the rear wall 21 is provided with a chamber 27 which is open towards the wall holder 3 and at its slot, open towards the wall holder 3; is provided with at least one projecting shoulder 28 at the top rim. Seated in this chamber 27 with one of its two legs is an angular piece or an angular rail 29 which is adapted to the length of the wall holder 3. The other leg of the angular piece 29 extends horizontally below a toroidal portion 31 formed on the wall holder 3 and contains a through-bore 32 in which a headed screw 33 is inserted from below and screwed into a threaded hole 34 in the toroidal portion 31. In cooperation with the shoulder 28, the angular rail 29 which is provided in the region of each of the two wall holders 3 prevents tilting of the cassette housing 2 about an axis in the region of the hook 26 of the two wall holders 3.

Beside the chamber 27, in the direction towards the interior the cassette housing 2, is a further chamber 35 of L-shaped cross-section which extends with a leg beneath the chamber 27. This chamber 35 contains a filling piece 36 which is adapted in cross-section to the shape of the chamber 35 and extends over the entire length of the cassette housing 2. The filling piece 36 serves in a manner described in further detail hereinbelow to receive threaded bores for further attachment screws, if the thickness of the wall and the strength of the material for the extruded part 13 are not adequate for this.

The inside wall 16 of the curved section 18 follows at a constant distance the roll of awning cloth 9 wound on the winding shaft 8 and forms at the bottom end a hook-shaped bar 37 projecting downwardly into the interior and lying at a short distance below the axis 19 of the winding shaft 8. The hook-shaped bar 37 is arranged in front of the bulge 22. Inserted in the groove delimited by the bulge 22 and the hook-shaped bar 37 is a top continuation 38 of the hinge part 23 at the wall side which follows with its rear side the inside wall 16 of the rear wall 21. A step 39 with two plane surfaces 41 and 42 extending at right angles to one another is formed at the bottom end in the hinge part at the wall side. The hinge part 23 at the wall side stands with the plane surface 41 on an upwardly pointing, likewise approximately plane shoulder on the outside of the chamber 35, while the surface 42 which extends vertically lies against a likewise vertically extending outside wall of the chamber 35. In the region of the contact surface 42, the step 39 forms a downwardly pointing continuation 43 through which an attachment screw 44 is guided and screwed into a threaded bore in the filling piece 36. Hence, in the interplay between the continuation 38 and the step 39, all of the forces and moments of the hinge part 23 at the wall side are directed into the rear wall 21 of the extruded shaped part 13 and are transferred directly from there onto the wall holders 3. For this reason, it is also preferable for the hinge parts 23 at the wall side to be in the immediate region of the wall holders 3 in order to keep the mechanical load for the cassette housing 2 low.

From the bottom rim 7 onwards, the bottom sheet-metal shaped part 14 follows a quarter-circle curved section as far as the underside of the chamber 35 where it passes over into a horizontally extending cover plate 45 for the screw 33 and the angular rail 29. The radius of curvature in the curved part corresponds to the radius of curvature of the outside wall 15 of the curved section 18. It is attached to the extruded shaped part 13 by several screws 40, likewise screwed into the filling piece 36.

On the other side of the bottom rim 7, the sheet-metal shaped part 14 constitutes a guiding surface 46 which projects from the bottom rim 7 upwards out of the cassette slot 5 in the direction towards the front side. As the Figure shows, the bottom rim 7 and the top rim 6 lie in a common vertical plane which also contains the axis 19 of the winding shaft 8.

Figure 3:
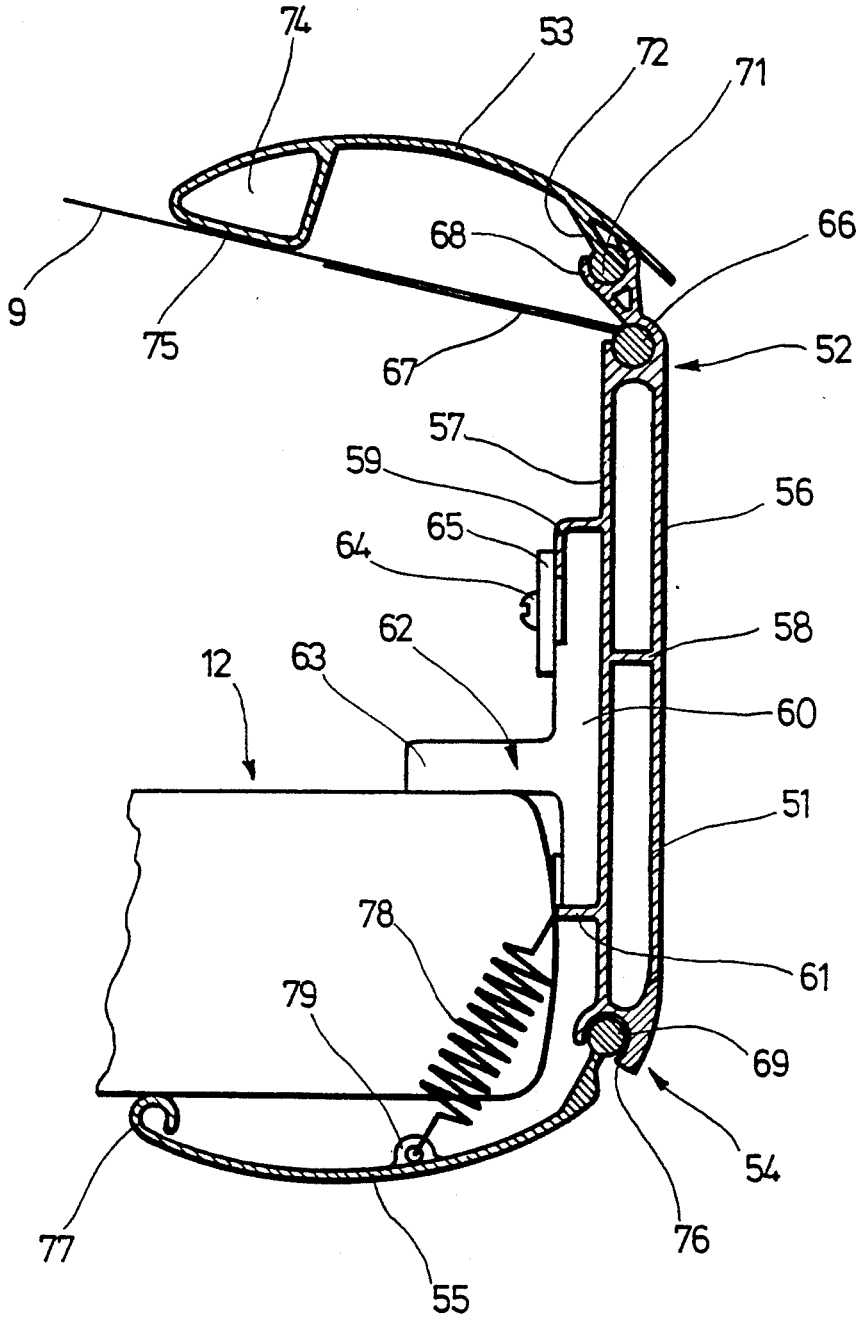

The drop rail 11, shown in cross-section in both FIGS. 2 and 3, but in different operating positions. In accordance with a feature of the invention, the drop rail 11 is a multi part structure which has a main part 51 extending over the length of the cassette opening 5, and one or more flaps 53, 55 hinged thereto, as shown, a top flap 53 is hinged to the top edge 52 (FIG. 3) of part 51 and a bottom flap 55 to its bottom edge 54.

The main part 51 is a double-walled extruded part with an outside wall 56 and an inside wail 57 facing the interior of the cassette housing 2. Both walls 56 and 57 are essentially smooth and extend parallel to one another. They are joined by transversely extending bars 58.

The inside wall 57 is provided with a continuous, downwardly angled bar 59 which is integrally formed on the inside wall 57, approximately in the upper half thereof.

A further supporting bar 61 extends parallel and in spaced relation to the downwardly angled bar 59 which constitutes a hook which is open in the downward direction. The downwardly angled bar 59 forms together with the bar 61 projecting at a right angle from the inside wall 57 a receiving device for a hinge part 62 on the drop rail side for the free end of the pertinent articulated arm 12. This hinge part 62 consists of a plate 63 which, as shown, is inserted between the downwardly angled bar 59 and the bar 61 and carries an inwardly projecting arm 60. The hinge part 62 is secured to the downwardly angled bar 59 by a clamping screw 64 and a washer 65 underneath it.

Formed in a known way in the region of the top edge 52 of the main part 51 in the inside wall 57 is a rand groove 66 in which the corresponding edge of the awning cloth 9 is hung in a known way by means of a loop 67.

Above the rand groove 66 there is a groove 68 of circular cross-section which is open upwardly at an incline and forms a hinge part for the flap 53. A further groove 69 of identical design, but open downwardly, extends at the bottom edge 54 of the main part 51. Both grooves 59 and 68 lie parallel and in spaced relation to one another and extend about a center square greater than 180°.

The top flap 53 is a curved extruded part of arcuate shape which is integrally provided in the region of the bottom or rear edge with a cylindrical toroidal portion 71 which is connected by a bar-like stem 72 to the inside of the flap 53. The radius of curvature of the flap 53 corresponds to the radius of curvature of the outside of the extruded shaped part 13.

The cylindrical toroidal portion 71 lies, as shown, radially secured, in the cylindrical groove 68 so that the flap 53 is pivotable to a limited extent relative to the main part 51, with the pivot axis extending parallel to the axis of rotation of the winding shaft 8.

The end of the flap 53 remote from the toroidal portion 71 is designed as a chamber 74 of approximately triangular cross-section, with a downwardly pointing sliding or bearing surface 75.

The bottom flap 55 is similar in shape to the top flap 53 and also has the same radius of curvature as it. The bottom flap 55 ends at its edge adjacent to the main part 51 in a cylindrical toroidal portion 76 which lies in the cylindrical groove 69 and so the flap 55 is also pivotable to a limited extent relative to the main part 51, with the axis lying parallel to the axis of rotation 19 of the winding shaft 8.

The end 77 remote from the thus formed hinge is rolled inwards to obtain a blunt rounded edge.

Whereas the flap 53 endeavours of its own accord on account of gravity to swing in the direction towards the awning cloth 9, with the bottom flap 55 this is achieved with the aid of a tension spring 78 in the form of a helical spring which is hooked at one end onto the bar 61 and at the other end into an eyelet 79 which is adhesively connected to the inside of the flap 55.

The cassette-type awning 1 described so far operates as follows, and from the description of the way in which it operates further dimensions not indicated in detail are also evident.

In the closed state, shown in FIG. 2, the awning cloth 9 is completely wound up into a ball on the winding shaft 8, and the inside dimensions of the cassette housing 2 are such that the awning cloth 9 does not graze anywhere. In this position, the top flap 53 rests on the top rim 6 of the cassette opening 5, and for better sealing a profiled rubber seal 81 having the shape shown in FIG. 2 can be fixedly screwed by screws 82 to the top free rim of the extruded shaped part 13. The rubber seal 81 has an approximately V-shaped groove 83 which faces the flap 53 and in which the flap 53 is inserted with its front free edge in the region of the chamber 74. In this position, the flap 53 which is approximately as long as the arc of a quarter-circle supplements the outside of the curved section 18 of the extruded shaped part 13 to form a semicircle. The main part 51 extends vertically from the bottom edge of the flap 53 and hence parallel to the wall to which the cassette awning 1 is attached. The vertical extent of the main part 51 of the drop rail 11 corresponds to the height of the vertical part of the rear wall 21 and extends approximately parallel to it. At the bottom edge 54, the bottom flap 55 which likewise is approximately as long as the arc of a quarter-circle adjoins the main part 51. The flap 55 rests with its free edge 77 on the bottom rim 7. The bottom flap 55 supplements with the same radius of curvature the correspondingly curved part of the sheet-metal shaped part again to form a semi-circle so that, in all, the cassette housing 2 has in cross-section an outer contour which corresponds to an oval.

The two articulated arms 12 are accommodated in a protected manner in the interior of the cassette housing 2, with their two arm sections 85 and 86 folded together in parallel relation to one another.

When, starting from this position, the cassette-type awning 1 is extended, i.e., moved into a position corresponding to FIG. 1, the winding shaft 8 is set in motion by hand or by motor drive to unwind the awning cloth 9. The two articulated arms 12 which join the drop rail 11 to the hinge part 23 on the wall side then gradually unfold from one another and the drop rail 11 moves away from the cassette opening 5. The top flap 53 is thereby released from the seal 81 and places itself loosely with the bearing surface 75 on the awning cloth 9. A relative movement between the top flap 53 and the awning cloth 9 does not take place. During the entire remaining extending movement the top flap 53 stays steadily on the awning cloth 9.

Likewise during the extension, the bottom flap 55, drawn by the spring 78, slides upwards along the sliding or guiding surface 46 until it rests on corresponding parts of the articulated arm 12, which stops further upward movement.

To prevent collisions between the articulated arms 12 and the guiding surface 46, the guiding surface has corresponding clearances at those points at which the two articulated arms 12 move.

With the new design of the drop rail 11, the cassette opening obtained during the extension is of such size that the two articulated arms 12 can move out through it without any hindrance and there is also no grazing of the awning cloth 9 anywhere. At the same time, the movable flaps 53 and 55 which in the extended state are pivoted in the direction towards the awning cloth or lie directly on it, reduce the maximum vertical height of the drop rail 11, which maintains a pleasing appearance of the drop rail 11, as is apparent from the perspective view in FIG. 1, in spite of the enormous height of the cassette opening 5. Conversely, when the awning 1 is retracted, the top flap 53 is guided by the awning cloth 9 running tangentially onto the roll into the V-shaped groove 83 of the top seal 81 without a relative movement taking place between the awning cloth 9 and the flap 53.

The height of the triangular chamber 54 is of such dimensions that the front free edge of the flap 53 readily finds its way into the groove 83 and is guided there by cooperation with the surface 75 in such a way that the semicylindrical configuration is created at the top of the cassette housing 2.

While the drop rail 9 runs in, the rounded edge 77 of the bottom flap 55 enters into engagement with the guiding device 46, whereby the bottom flap 55 is pivoted downwards against the action of the spring 78, as shown by positions 77' and 77'' indicated by dot-and-dash lines. In the end position, the outside of the flap 55 forms the smooth continuation of the sheet-metal shaped part 14 at the bottom of the cassette housing 2.

The drop rail 11 closes completely, as shown in FIG. 2, the large cassette opening 5 over the entire length between the two end caps 4 and over the entire height between the two rims 6 and 7. In this way, the awning cloth 9 and also the articulated arms 12 are completely protected in the interior of the cassette housing 2 and the dirt rim on the awning cloth 9 which otherwise occurs in awnings near the drop rail is reliably prevented.

At the same time, the new cassette-type awning shows in the retracted state a closed exterior with essentially smooth surfaces, with the way in which the flaps 53 and 55 are attached to the main part 1 also contributing to this.

What is claimed is:

1. Cassette-type awning (1) comprising:

a cassette housing (2) attached to wall holders (3) and having a wall side and a front side, remote from said wall holders (3);

a cassette opening (5) at said front side extending essentially over the entire length of said cassette housing (2) and delimited by a top rim (6), a bottom rim (7) and two side rims, a winding shaft (8) rotatably mounted in said cassette housing (2) and having an edge of an awning cloth (9) attached to it, articulated arms (12) accommodated when in the closed state, in said cassette housing (2), and having hinging means (23) for hinging inner ends thereof at the wall side to said cassette housing, said articulated arms (12) having front ends remote from said inner ends at the wall side and pivoting out of said cassette opening (5) when said awning (1) is extended, a drop rail (11), said drop rail forming a multipart structure having a main part (51) having an edge of said awning cloth (9) remote from said winding shaft (8) attached to it and being hinged to said front ends of said articulated arms (12), and at least one flap (53, 55), hinged to said main part (51) and having essentially the same length as said main part (51), said drop rail (11) essentially closing said cassette opening (5) completely when said awning (1) is fully retracted, and said at least one flap (53, 55) moving in the direction towards said awning cloth (9) when said awning (1) is being extended.

2. Awning as defined in claim 1, characterized in that said drop rail (11) is in contact with at least said top and bottom rims (6, 7) of said opening (5) when said awning (1) is closed.

3. Awning as defined in claim 1, characterized in that one of said at least one flap is arranged below said main part (51), forming a bottom flap.

4. Awning as defined in claim 3, characterized in that said drop rail (11) has a second flap (53), forming a top flap extending over the entire length of said main part (51) and being hinged to said main part (51) along an upper edge (52), said bottom flap (55) being hinged to a lower edge (54) of said main part (51)).

5. Awning as defined in claim 1, characterized in that said bottom rim (7) of said cassette opening (5) extends near a vertical plane containing the axis (19) of said winding shaft (8).

6. Awning as defined in claim 1, characterized in that said top rim (6) of said cassette opening (5) extends near a vertical plane containing the axis (19) of said winding shaft (8).

7. Awning as defined in claim 1, wherein in the completely retracted state, said awning (1) has, in cross-section, an outer contour which approximately represents an oval which is delimited by two semicircular arcs with the same radius of curvature and side edges extending parallel to one another.

8. Awning as defined in claim 3 characterized by a spring device (78) acting between said one flap (55) and said main part (51) providing upward spring bias with the effect of an upwardly directed pivoting movement.

9. Awning as defined in claim 8, characterized in that said spring device (78) is at least one spring which is supported at one end on said bottom flap (55) and at the other end on said main part (51).

10. Awning as defined in claim 9, characterized in that said spring device (78) contains at least two springs.

11. Awning as defined in claim 9, characterized in that said at least one spring (78) is a helical spring.

12. Awning as defined in claim 8, characterized in that a guiding device (46) is provided, located in the region of said bottom rim (7) and associated with said cassette opening (5) and cooperates with said bottom flap (55) with the effect of a pivoting away against the action of said spring device (78).

13. Awning as defined in claim 12, characterized in that said guiding device (46) forms a concave sliding surface curved in the shape of part of a circle which ends at said bottom rim (7) of said cassette opening (5) and then extends upwards a short distance from there.

14. Awning as defined in claim 1, characterized in that said cassette housing (2) is an at least two-part structure, extending in said longitudinal direction.

15. Awning as defined in claim 14, characterized in that said cassette housing (2) is at least, in part, an extruded shaped part (13).

16. Awning as defined in claim 14, characterized in that said cassette housing (2) has a bottom portion (14) of rolled sheet-metal.

17. Awning as defined in claim 1, characterized in that said main part (51) of said drop rail (11) is an extruded part.

18. Awning as defined in claim 1, characterized in that said main part (51) of said drop rail (11) is a rolled sheet-metal shaped part.

19. Awning as defined in claim 1, characterized in that said at least one flap (53, 55) is an extruded part.

20. Awning as defined in claim 1, characterized in that said at least one flap (53, 55) is a rolled sheet-metal shaped part.

21. Awning as defined in claim 1, characterized by at least one hinge (68, 71; 69, 76) joining said at least one flap (53, 55) to said main part (51), said at least one hinge extending over the entire length of said drop rail (11).

22. The awning as defined in claim 1, characterized in that said at least one flap is arranged above said main part (51), forming a top flap.

* * * * *